US009058951B2

(12) United States Patent
Augusta et al.

(10) Patent No.: US 9,058,951 B2
(45) Date of Patent: Jun. 16, 2015

(54) ELECTRICAL SWITCH

(71) Applicants: Zbynek Augusta, Letohrad (CZ); Filip Musil, Zachlumi (CZ)

(72) Inventors: Zbynek Augusta, Letohrad (CZ); Filip Musil, Zachlumi (CZ)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 13/710,520

(22) Filed: Dec. 11, 2012

(65) Prior Publication Data

US 2013/0187735 A1 Jul. 25, 2013

(30) Foreign Application Priority Data

Jan. 19, 2012 (DE) ..... 10 2012 200 728

(51) Int. Cl.

| | |
|---|---|
| ***H01H 75/12*** | (2006.01) |
| ***H01H 77/00*** | (2006.01) |
| ***H01H 9/00*** | (2006.01) |
| ***H01H 77/06*** | (2006.01) |
| *H01H 71/24* | (2006.01) |

(52) U.S. Cl.

CPC ..... *H01H 77/06* (2013.01); *H01H 71/2454* (2013.01); *H01H 71/2472* (2013.01); *H01H 2071/249* (2013.01)

(58) Field of Classification Search

USPC ..... 335/18, 174–176, 35

See application file for complete search history.

(56) References Cited

U.S. PATENT DOCUMENTS

| | | | | |
|---|---|---|---|---|
| 3,264,435 | A * | 8/1966 | Klein et al. | 337/48 |
| 3,317,867 | A * | 5/1967 | Powell | 335/37 |
| 4,284,968 | A * | 8/1981 | Denoyelle et al. | 335/176 |
| 5,250,918 | A * | 10/1993 | Edds et al. | 335/35 |
| 5,432,491 | A | 7/1995 | Peter et al. | |
| 5,870,008 | A * | 2/1999 | Pannenborg et al. | 335/35 |
| 6,194,982 | B1 * | 2/2001 | Mrenna et al. | 335/35 |
| 6,225,882 | B1 * | 5/2001 | Hood et al. | 335/172 |
| 6,326,869 | B1 * | 12/2001 | Felden et al. | 335/35 |
| 6,407,653 | B1 * | 6/2002 | Zindler et al. | 335/6 |
| 6,556,111 | B2 * | 4/2003 | Felden et al. | 335/172 |
| 6,759,245 | B1 | 7/2004 | Toner et al. | |
| 6,788,174 | B1 * | 9/2004 | Afshari et al. | 335/42 |
| 6,803,850 | B2 * | 10/2004 | Richter | 337/107 |
| 6,980,069 | B2 * | 12/2005 | O'Keeffe et al. | 335/35 |
| 8,040,209 | B2 * | 10/2011 | Faik et al. | 335/42 |

FOREIGN PATENT DOCUMENTS

| | | | |
|---|---|---|---|
| DE | 726620 | C | 10/1942 |
| DE | 2751451 | A1 | 5/1979 |

(Continued)

OTHER PUBLICATIONS

US 6,465,252, 10/2002, Toner et al. (withdrawn)

*Primary Examiner* — Alexander Talpalatski

(74) *Attorney, Agent, or Firm* — Harness, Dickey & Pierce, P.L.C.

(57) ABSTRACT

An electrical switch, in particular an electrical circuit breaker, is disclosed including an overcurrent trip device which cuts off the flow of current through the switch in the event of an overcurrent situation. In at least one embodiment, a partial current of the current flowing through the electrical switch flows through a tripping arrangement of the overcurrent trip device and at least one further partial current of the current flowing through the electrical switch is conducted past the tripping arrangement.

11 Claims, 5 Drawing Sheets

(56) References Cited

FOREIGN PATENT DOCUMENTS

| | | | |
|---|---|---|---|
| DE | 4445169 | A1 | 6/1996 |
| DE | 102004012285 | A1 | 10/2004 |
| DE | 60036385 | T2 | 6/2008 |
| EP | 0563775 | A1 | 10/1993 |
| EP | 1463082 | A1 | 9/2004 |
| FR | 2409594 | A | 6/1979 |

* cited by examiner

ELECTRICAL SWITCH

PRIORITY STATEMENT

The present application hereby claims priority under 35 U.S.C. §119 to German patent application number DE 10 2012 200 728.8 filed Jan. 19, 2012, the entire contents of which are hereby incorporated herein by reference.

FIELD

At least one embodiment of the invention generally relates to an electrical switch.

BACKGROUND

An example of a switch is marketed by Siemens AG under the product name 3VL TMTU. This switch is a circuit breaker which is equipped with an overcurrent trip device. In the event of an overcurrent situation the overcurrent trip device is able to cut off the flow of current through the switch.

SUMMARY

An embodiment of the invention discloses a switch in which the overcurrent trip device can be manufactured particularly cost-effectively.

Advantageous embodiments of the switch according to the invention are disclosed in dependent claims.

Accordingly it is provided in at least one embodiment that a part of the current flowing through the electrical switch flows through a tripping arrangement of the overcurrent trip device and at least one further part of the current flowing through the electrical switch is conducted past the tripping arrangement.

BRIEF DESCRIPTION OF THE DRAWINGS

The invention is explained in more detail below with reference to example embodiments; the figures show by way of example.

Figure 1:
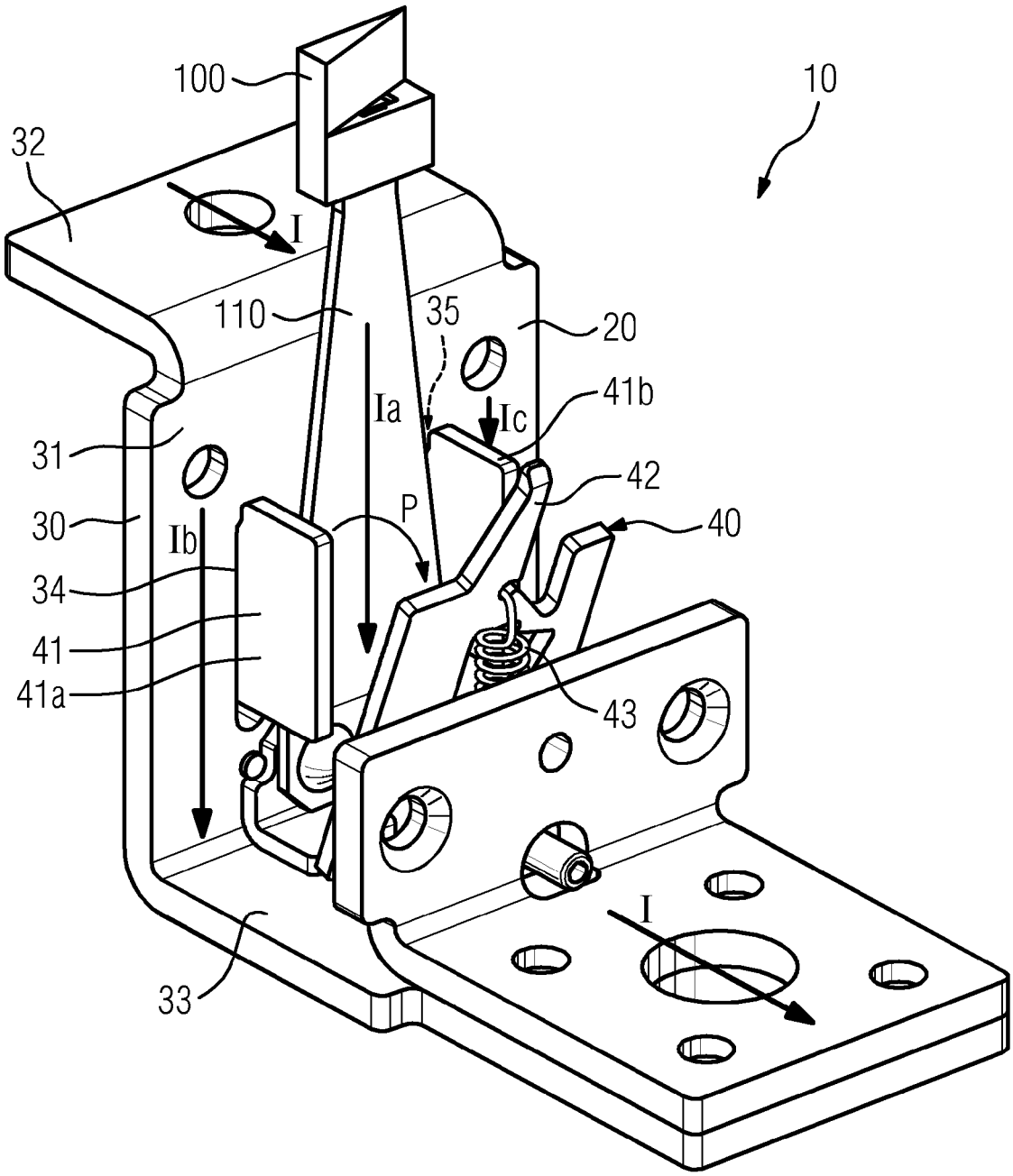
FIG. 1 an example embodiment of an overcurrent trip device for a switch according to the invention, wherein the overcurrent trip device is shown in a three-dimensional view obliquely from the front, FIG. 2 the overcurrent trip device according to FIG. 1 in a three-dimensional view from behind, FIG. 3 the overcurrent trip device according to FIGS. 1 and 2 in a cutaway view, a magnetic flux induced by an electric current being depicted in more detail, FIG. 4 further parts of the overcurrent trip device of the switch according to FIGS. 1 to 3, FIG. 5 a sheet metal part of the overcurrent trip device of the switch according to FIGS. 1 to 4 in greater detail, FIG. 6 another example embodiment of a sheet metal part for an overcurrent trip device, as can be used for a switch according to FIGS. 1 to 4, and FIG. 7 a third example embodiment of a sheet metal part for an overcurrent trip device.

For clarity of illustration, the same reference signs are used consistently in the figures for identical or comparable components.

DETAILED DESCRIPTION OF THE EXAMPLE EMBODIMENTS

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

Accordingly it is provided in at least one embodiment that a part of the current flowing through the electrical switch flows through a tripping arrangement of the overcurrent trip device and at least one further part of the current flowing through the electrical switch is conducted past the tripping arrangement.

A significant advantage of the switch according to at least one embodiment of the invention is to be seen in the fact that in the switch, instead of the total current that is to be switched flowing through the tripping arrangement of the overcurrent trip device, only a partial current flows therethrough. Because it is provided according to at least one embodiment of the invention to conduct current components past the tripping arrangement it is possible to dimension the tripping arrangement, and consequently the overcurrent trip device as a whole, as smaller and lighter than would be possible if all of the current were to flow through the tripping arrangement.

With regard to the embodiment of the tripping arrangement it is considered advantageous if the tripping arrangement has: a yoke part through which a partial current flows, and an armature part which interacts with the yoke part and which is moved or swiveled in the event of an overcurrent situation.

Subdividing the current can be achieved particularly easily and therefore advantageously if the overcurrent trip device has a sheet metal part having at least one opening into which the yoke part is inserted, wherein the current flowing through the electrical switch is subdivided into the partial current which flows through the yoke part, and the at least one further partial current which flows past the yoke part, through the sheet metal part.

It is considered particularly advantageous if the opening in the sheet metal part is slot-shaped. The longitudinal direction of the slot preferably extends along the current direction of the two partial currents.

A particularly easy and cost-effective assembly of the overcurrent trip device is possible if the yoke part is formed by means of a bar with U-shaped cross-section which is inserted into the opening in the sheet metal part, wherein the base of the bar with U-shaped cross-section bears against the side of the sheet metal part facing away from the armature part and one of the two side walls of the bar passes through the at least one opening in the sheet metal part.

With regard to the alignment of the at least one slot-shaped opening it is considered advantageous if the longitudinal direction of the bar part extends in parallel with the longitudinal direction of the at least one slot-shaped opening in the sheet metal part.

Reliable tripping of the overcurrent trip device can be achieved if in the event of an overcurrent situation the armature part interacting with the yoke part is moved or swiveled in the direction of the yoke part. Alternatively the armature part can be moved or swiveled away from the yoke part in the event of an overcurrent situation.

In order to ensure simple and reliable disconnection of the electrical switch when the overcurrent trip device is tripped, it is considered advantageous if the overcurrent trip device has a shaft having a switching lug which interacts with the armature part of the tripping arrangement and which in the event of an overcurrent situation is moved in unison by the armature part of the tripping arrangement.

It is furthermore considered advantageous if the sheet metal part has a sheet metal section in which the at least one opening for receiving the yoke part is provided, as well as at least one sheet metal section having a 90° offset thereto which extends in parallel with the two side walls of the bar and conducts both the one partial current and the at least one further partial current. The sheet metal section or sheet metal sections having a 90° offset can preferably be used to conduct the total current made up of the partial currents.

The electrical switch can be for example a multiphase electrical switch. In this case it is considered advantageous if the switch has an individual tripping arrangement for each electrical phase. Preferably only one partial current of the associated phase current flows through each tripping arrangement in each case, and at least one further partial current of the respective phase current is conducted past the respective tripping arrangement.

In other words the above statements apply analogously to a multiphase electrical switch when each phase is provided with an individual tripping arrangement and for each of the tripping arrangements the current is split up into partial currents, as described hereinabove.

FIG. 1 shows components of an electrical switch 10 in greater detail. An overcurrent trip device 20 can be seen comprising a sheet metal part 30 and a tripping arrangement 40. The sheet metal part 30 has a middle sheet metal section 31, adjacent to which are two sheet metal sections 32 and 33 having a 90° offset. The middle sheet metal section 31 is provided with two slot-shaped openings 34 and 35 which are arranged in parallel with one another.

The switch 10 is suitable or intended for switching a current, which is labeled with the reference sign I in FIG. 1. In the illustration according to FIG. 1 the current I flows from the top sheet metal section 32 having a 90° offset, over the middle sheet metal section 31, to the bottom sheet metal section 33 having a 90° offset.

As can be seen in FIG. 1 and as is explained in greater detail further below, the current I is subdivided in the middle sheet metal section 31 into three partial currents, of which one partial current is labeled with the reference sign Ia, a further partial current is labeled with the reference sign Ib, and a third partial current is labeled with the reference sign Ic.

The tripping arrangement 40 comprises a yoke part 41 which is stationary or immovable with respect to the sheet metal part 30 and which is formed by a bar which is U-shaped in cross-section. The yoke part 41 consists of a magnetizable material, such as iron, for example, and has two side walls 41*a* and 41*b* which are arranged in parallel with one another and which pass through the two slot-shaped openings 34 and 35 in the sheet metal part 30. In FIG. 1, the base of the yoke part 41 is hidden by the sheet metal part 30. The longitudinal direction of the bar with U-shaped cross-section is identical to the longitudinal direction of the slot-shaped openings 34 and 35 as well as to the direction of the partial currents Ia, Ib and Ic.

In addition to the yoke part 41, the tripping arrangement 40 also comprises a movable armature part 42 which can be a hinged clapper-type armature for example. The armature part 42 consists of a magnetizable material such as iron, for example, and is subjected to the spring force of a spring 43 which swivels or wants to swivel the armature part 42 away from the yoke part 41 along the direction of the arrow P. As will be explained in greater detail further below, the armature part 42 is swiveled against the spring force of the spring 43 in the direction of the yoke part 41 if the current I or its partial current Ia through the switch 10 exceeds a predefined threshold.

Also to be seen in FIG. 1 is a thermal trip device 100 which is fixed to the sheet metal part 30. The thermal trip device 100 comprises a bimetallic element 110 which causes the switch 10 to be disconnected in the event of an excessively high switch temperature. However, the mode of operation of the thermal trip device 100 is of no relevance to the further explanations in respect of the mode of operation of the overcurrent trip device 20.

Figure 2:
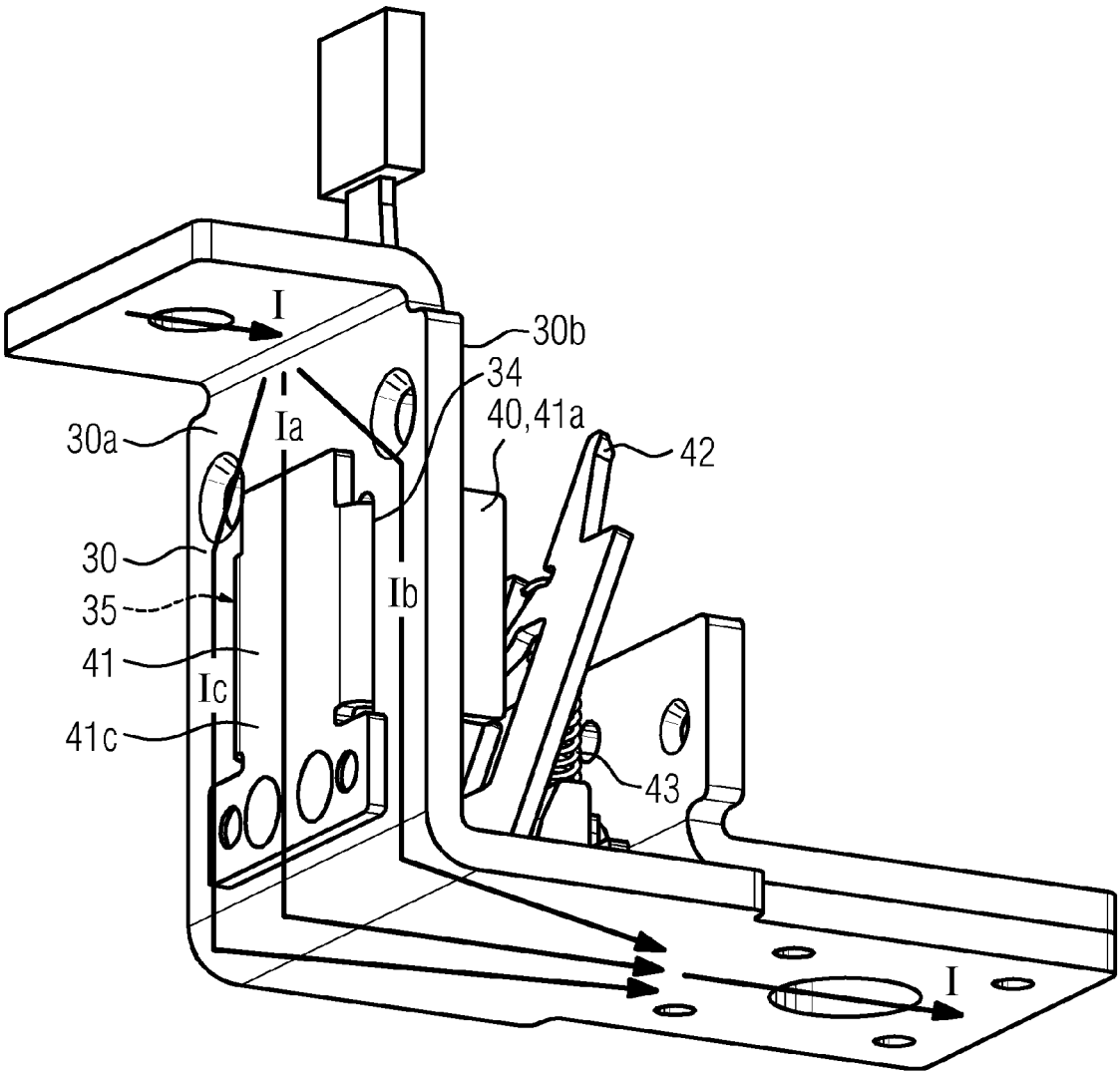

FIG. 2 shows the sheet metal part 30 and the tripping arrangement 40 in a different view. It can be seen that the yoke part 41 or the U-shaped bar has a base 41*c* which fits flat against the side 30*a* of the sheet metal part 30 facing away from the armature part 42. The two side walls 41*a* and 41*b* (cf. FIG. 1) extend away from the base 41*c* at right angles such that they pass through the two slot-shaped openings 34 and 35 in the sheet metal part 30 and reach the side 30*b* of the sheet metal part 30 facing toward the armature part 42.

It can also be clearly seen in FIG. 2 how the current I is subdivided into the partial currents Ia, Ib and Ic. One of the partial currents, specifically the middle partial current Ia, flows through the base 41*c* of the yoke part 41, whereas the two other partial currents Ib and Ic are conducted past the yoke part 41 and consequently also past the tripping arrangement 40 as a whole. Thus, only the partial current Ia flows through the tripping arrangement 40, which therefore also means that only the size of said partial current Ia is a determining factor for the mode of operation or for the tripping of the tripping arrangement 40.

The spring 43 which swivels the armature part 42 away from the yoke part 41 can also be seen in FIG. 2.

Figure 3:
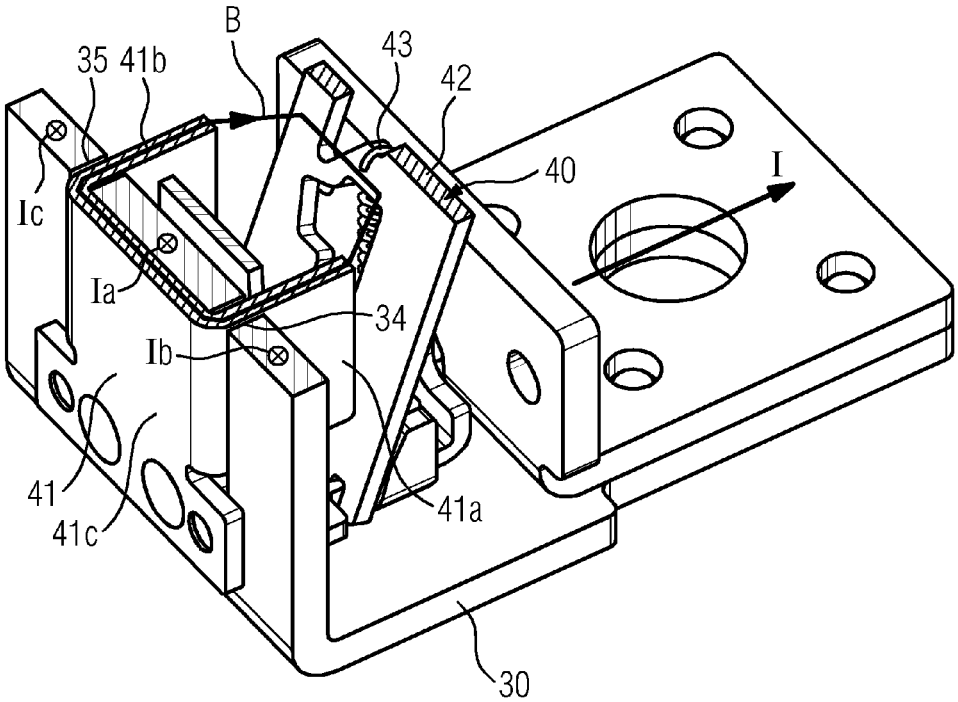

FIG. 3 shows the principle of operation of the tripping arrangement 40 in greater detail. It can be seen that a magnetic flux B is generated by the partial current Ia which flows through the yoke part 41, which magnetic flux B, starting from the base 41*c* of the yoke part 41, flows via the side wall 41*b*, through an air gap between the side wall 41*b* and the armature part 42, via the armature part 42, through an air gap between the armature part 42 and the side wall 41*a*, and finally to the base 41*c* of the yoke part 41.

If the current Ia exceeds a predefined threshold value which is specified or determined by the spring force of the spring 43, then the magnetic force of the magnetic flux B will be sufficient to pull the armature part 42 against the spring force of the spring 43 to the yoke part 41 such that the two air gaps are closed and a closed magnetic circuit is formed by the yoke part 41 and the armature part 42.

The hinging movement of the armature part 42 displaces a mechanism (not shown in further detail in FIG. 3) which effects or triggers a disconnection of the switch.

An advantageous aspect of the mode of operation of the tripping arrangement 40 or, as the case may be, of the overcurrent trip device as a whole can be seen very graphically in FIG. 3. Thus it is shown that only the partial current Ia flows through the yoke part 41 and accordingly can trigger a movement of the armature part 42 or a disconnection of the switch. The two other partial currents Ib and Ic are conducted past the yoke part 41 and consequently past the tripping arrangement 40, which means that said partial currents play no part in the mode of operation of the tripping arrangement 40.

An advantage of the tripping arrangement 40 according to FIGS. 1 to 3 therefore consists in the fact that the mechanical parts of the tripping arrangement 40, in particular the stability of the armature part 42 and the spring force of the spring 43, do not have to be dimensioned with a view to the total current I flowing through the switch, but only with a view to the partial current Ia which flows through the tripping arrangement 40. Because only the partial current Ia flows through the tripping arrangement 40, the components of the tripping arrangement 40 can be dimensioned smaller and lighter than would be the case if the total current I were to flow through the tripping arrangement 40.

Figure 4:
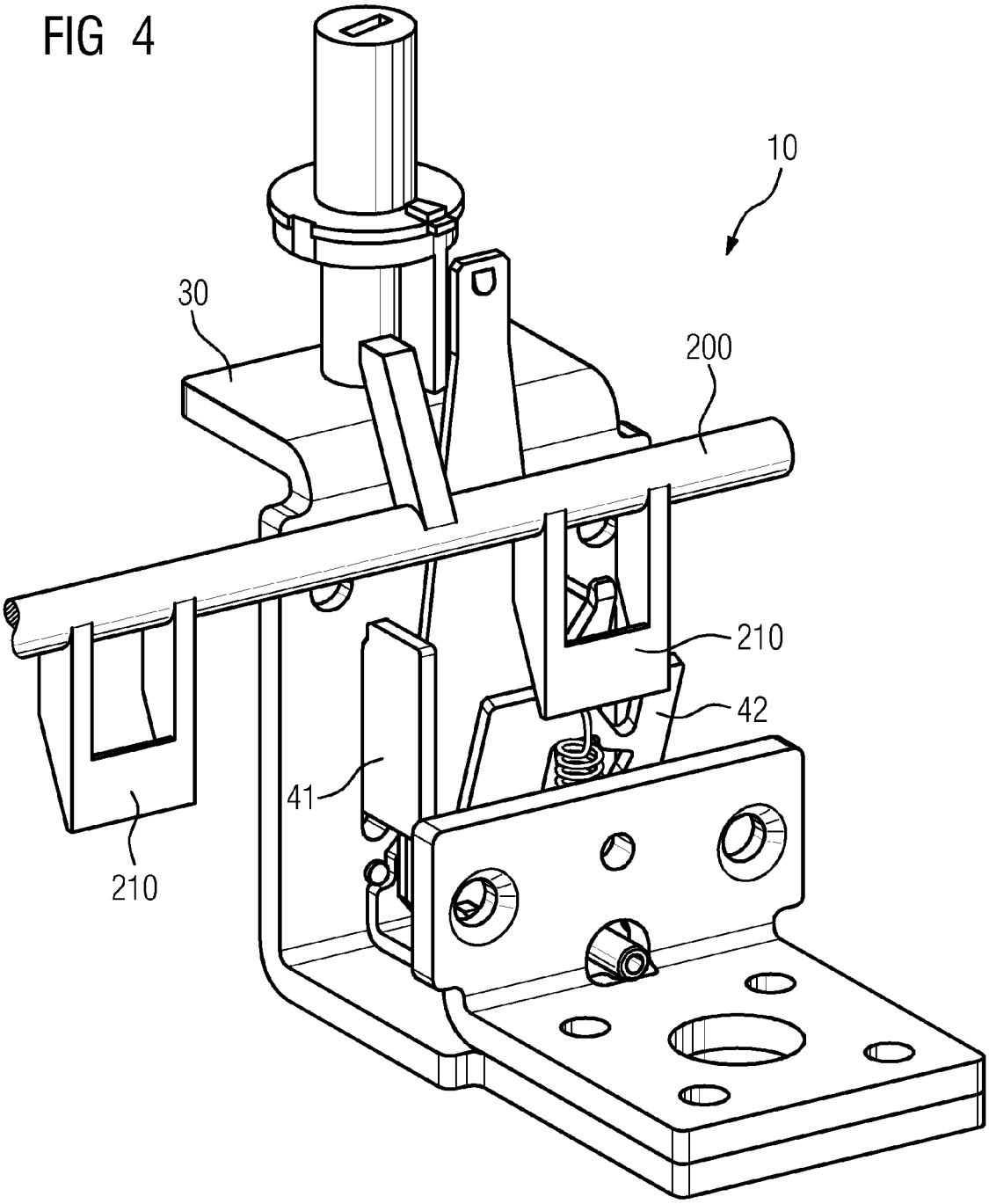

FIG. 4 shows further components of the switch 10 according to FIGS. 1 to 3. A shaft 200 can be seen which is equipped with a switching lug 210 in each case for each electrical phase of the switch 10 that is to be switched. As FIG. 4 shows, one of the switching lugs 210 interacts with the armature part 42 in such a way that when the armature part 42 is displaced or swiveled in the direction of the yoke part 41 it enables a movement of the switching lug 210 and consequently a rotation of the shaft 200 by means of which a tripping of the switch 10 or a disconnection of the switch 10 is effected or at least can be effected.

Figures 5, 6, 7:
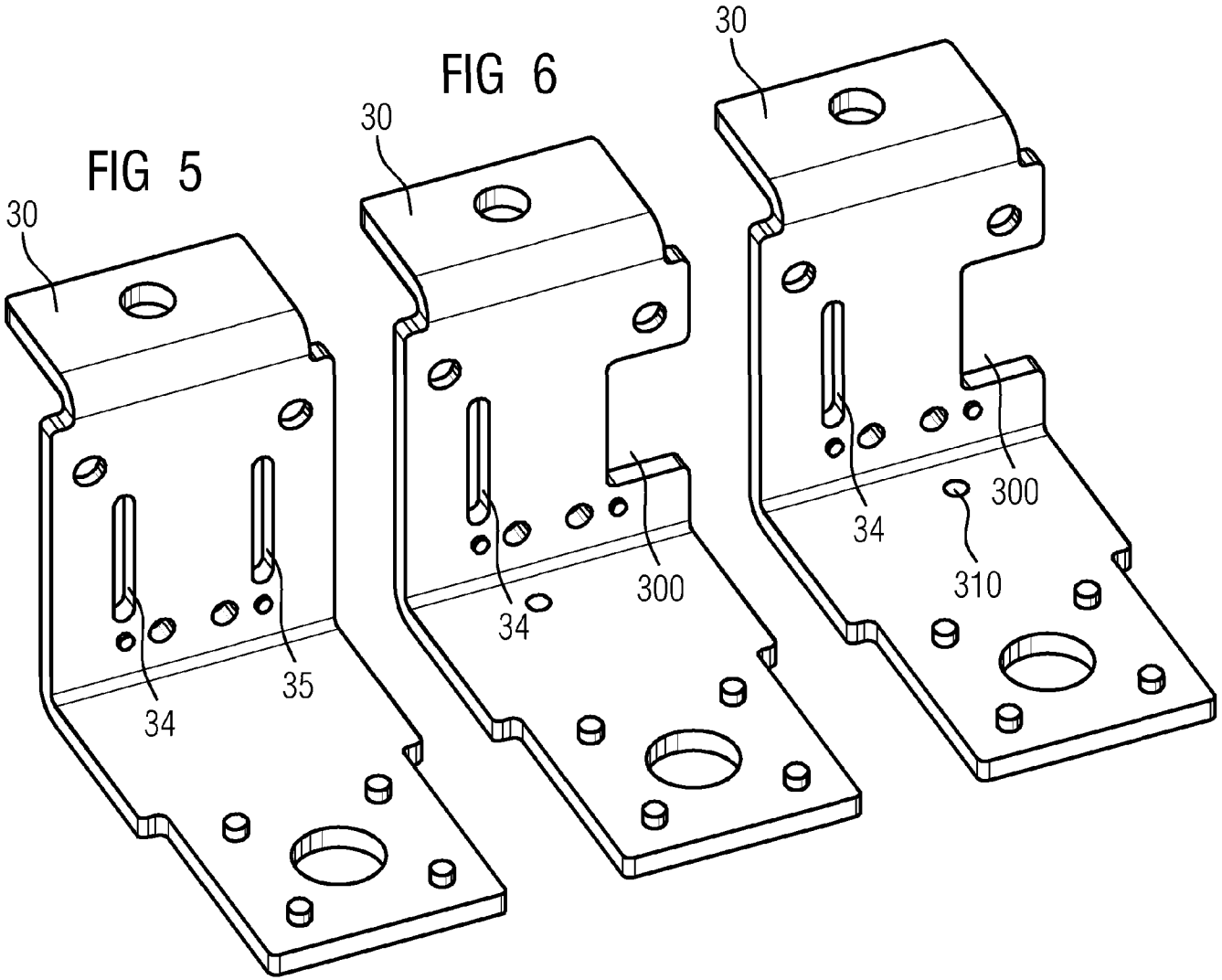

FIG. 5 shows the sheet metal part 30 of the tripping arrangement 40 according to FIGS. 1 to 4 once again in greater detail. The two slot-shaped openings 34 and 35 can be seen, aligned in parallel with one another. The longitudinal direction of the two slot-shaped openings 34 and 35 corresponds to the current direction of the partial currents which flow through the sheet metal part 30.

FIG. 6 shows another embodiment variant of the sheet metal part 30. It can be seen that the sheet metal part 30 has only a single slot-shaped opening 34. In the exemplary embodiment according to FIG. 6, instead of a second slot-shaped opening, a cutout 300 is present which enables a yoke part (in the form of a bar with U-shaped cross-section for example) to be inserted.

FIG. 7 shows a further example embodiment of a sheet metal part 30 which is provided with a slot-shaped opening 34 and a cutout 300. The sheet metal part 30 according to FIG. 7 differs from the sheet metal part according to FIG. 6 only in respect of a fixing hole 310 whose position is arranged differently than in the case of the sheet metal part 30 according to FIG. 6.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

Although the invention has been illustrated and described in greater detail with reference to preferred exemplary embodiments, it is not limited by the examples disclosed and other variations may be derived herefrom by the person skilled in the art without leaving the scope of protection of the invention.

LIST OF REFERENCE SIGNS

10 switch
20 overcurrent trip device
30 sheet metal part
30*a* side facing away
30*b* side facing toward
31 sheet metal section
32 sheet metal section
33 sheet metal section
34 opening
35 opening
40 tripping arrangement
41 yoke part
41*a* side wall
41*b* side wall
41*c* base
42 armature part
43 spring
100 thermal trip device
110 bimetallic element
200 shaft
210 switching lug
300 cutout
310 fixing hole
B magnetic flux
I current
Ia partial current
Ib partial current
Ic partial current
P direction of arrow

What is claimed is:

1. An electrical switch, comprising:

an overcurrent trip device configured to cut off a flow of current through the switch in an overcurrent situation, the overcurrent trip device including a tripping arrangement configured such that a first partial current of the current flowing through the electrical switch flows through the tripping arrangement, and such that at least one second partial current of the current flowing through the electrical switch is conductable past the tripping arrangement, the tripping arrangement including, a yoke part through which the first partial current flows, and an armature part configured to interact with the yoke part, the armature part being movable or swivelable in response to a magnetic flux caused by only the first partial current flowing through the yoke part in the event of an overcurrent situation such that the first partial current alone is sufficient to move or swivel the armature part, wherein the overcurrent trip device includes a sheet metal part, the sheet metal part including a first section that has at least one opening into which the yoke part is insertable, and wherein the first partial current flows through the yoke part in a same direction as the at least one second partial current that flows through the first section.

2. The switch of claim 1, wherein the at least one opening in the sheet metal part is slot-shaped, a longitudinal direction of the slot extending along a current direction of the first partial current and the at least one second partial current.

3. The switch of claim 2, wherein the yoke part is formed by a bar with U-shaped cross-section which is insertable into the at least one opening in the sheet metal part in such a way that a base of the bar with U-shaped cross-section bears against a side of the sheet metal part facing away from the armature part and one of the two side walls of the bar passes through the at least one opening in the sheet metal part.

4. The switch of claim 3, wherein the longitudinal direction of the bar extends in parallel with the longitudinal direction of the at least one slot-shaped opening in the sheet metal part.

5. The switch of claim 1, wherein, in the event of an overcurrent situation, the armature part interacting with the yoke part is moved or swiveled in the direction of the yoke part.

6. The switch of claim 1, wherein the overcurrent trip device includes a shaft including a switching lug that is configured to interact with the armature part of the tripping arrangement and wherein, in the event of an overcurrent situation, the shaft is moved in unison by the armature part of the tripping arrangement.

7. The switch of claim 3, wherein the sheet metal part includes at least one second section having a 90° offset from the first section such that the at least one second section extends away from the first section that is in parallel with the two side walls of the yoke part and such that the at least one second section conducts both the first partial current and the at least one second partial current.

8. The switch of claim 1, wherein the electrical switch is a multiphase electrical switch that includes a phase-specific tripping arrangement for each individual electrical phase, a partial current of the associated phase current flowing in each phase through each of the tripping arrangements and at least one further partial current of the respective phase current being conducted past the respective tripping arrangement.

9. The switch of claim 1, wherein the electrical switch is an electrical circuit breaker.

10. The switch of claim 1, wherein the yoke part is formed by a bar with U-shaped cross-section which is insertable into the at least one opening in the sheet metal part in such a way that a base of the bar with U-shaped cross-section bears against a side of the sheet metal part facing away from the armature part and one of the two side walls of the bar passes through the at least one opening in the sheet metal part.

11. The switch of claim 1, wherein the sheet metal part includes a second section and a third section, the first section being between the second section and the third section and offset from the second section and the third section by 90°, and wherein the armature is a hinged-clapper type armature having a first end fixedly connected to the third section and a second end connected to a spring element.

* * * * *